US007530392B2

(12) United States Patent
Sugiyama et al.

(10) Patent No.: US 7,530,392 B2
(45) Date of Patent: May 12, 2009

(54) METHOD AND SYSTEM FOR DEVELOPMENT OF HYDROCARBON BEARING FORMATIONS INCLUDING DEPRESSURIZATION OF GAS HYDRATES

(75) Inventors: Hitoshi Sugiyama, Sagamihara (JP); Brian W. Cho, Yokohama (JP); Shunetsu Onodera, Cheltenham (GB); Ahmed H. Al-Jubori, Calgary (CA); Masafumi Fukuhara, Sagamihara (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 122 days.

(21) Appl. No.: 11/612,489

(22) Filed: Dec. 19, 2006

(65) Prior Publication Data

US 2007/0144738 A1 Jun. 28, 2007

Related U.S. Application Data

(60) Provisional application No. 60/752,118, filed on Dec. 20, 2005.

(51) Int. Cl.
*E21B 43/40* (2006.01)
*E21B 47/06* (2006.01)

(52) U.S. Cl. ..... 166/263; 166/68; 166/75.12; 166/250.07; 166/267; 166/309; 166/370; 166/371

(58) Field of Classification Search ..... None
See application file for complete search history.

(56) References Cited

U.S. PATENT DOCUMENTS

| | | | | |
|---|---|---|---|---|
| 3,718,407 | A | 2/1973 | Newbrough | |
| 4,376,462 | A | 3/1983 | Elliott et al. | |
| 4,424,858 | A | 1/1984 | Elliott et al. | |
| 6,260,627 | B1 | 7/2001 | Rivas | |
| 6,281,489 | B1 * | 8/2001 | Tubel et al. | 250/227.14 |
| 6,343,653 | B1 | 2/2002 | Mason et al. | |
| 2005/0155768 | A1 * | 7/2005 | Bolin et al. | 166/370 |
| 2005/0166961 | A1 * | 8/2005 | Means et al. | 137/13 |
| 2006/0032637 | A1 | 2/2006 | Ayoub et al. | |
| 2007/0056729 | A1 * | 3/2007 | Pankratz et al. | 166/265 |

(Continued)

FOREIGN PATENT DOCUMENTS

DE 19849337 A1 1/2000

(Continued)

OTHER PUBLICATIONS

Williams et al., Methane Hydrate Production from Alaskan Permafrost, Gas Hydrate Project Production Testing; North Pole, Alaska, Topical Report Jan. 1, 2003 to Mar. 31, 2003, DE-FC26-01NT41331, Apr. 2003, pp. 1-6.

*Primary Examiner*—Zakiya W. Bates
(74) *Attorney, Agent, or Firm*—Matthias Abrell; Jaime Castano; Dale Gaudier

(57) ABSTRACT

A method and system for the production of a gas hydrate including the steps of drilling into a subterranean gas hydrate formation and at least partially depressurizing the gas hydrate formation to permit separation of gas and water from the hydrate form. The gas and water is then pumped from the formation and recovered from the well. At least a portion of water pumped from the well is water that is introduced into the well from the surface or reintroduced by a feed back loop from the production operation.

28 Claims, 5 Drawing Sheets

U.S. PATENT DOCUMENTS

2007/0289740 A1* 12/2007 Thigpen et al. ..... 166/250.01

FOREIGN PATENT DOCUMENTS

RU 2231635 C1 6/2004
SU 1574796 A1 6/1990
WO WO 03/021079 A1 3/2003
WO WO 2005/111372 A1 11/2005

* cited by examiner

METHOD AND SYSTEM FOR DEVELOPMENT OF HYDROCARBON BEARING FORMATIONS INCLUDING DEPRESSURIZATION OF GAS HYDRATES

CROSS-REFERENCE TO RELATED APPLICATION

This application relates to and claims the benefit under 35 U.S.C. § 119(e) of applicants' U.S. Provisional Application Ser. No. 60/752,118 entitled "Systems and Method for Development of Hydrocarbon Bearing Formations," filed Dec. 20, 2005. The disclosure of this Provisional Application is hereby incorporated by reference as though set forth at length.

BACKGROUND

This invention is generally related to a method and system for recovering gas from subterranean gas hydrate formations. More particularly, this invention relates to a method and system for producing methane gas sequestered within subterranean methane hydrates.

A gas hydrate is a crystalline solid that is a cage-like lattice of a mechanical intermingling of gas molecules in combination with molecules of water. The name for the parent class of compounds is "clathrates" which comes from the Latin word meaning "to enclose with bars." The structure is similar to ice but exists at temperatures well above the freezing point of ice. Gas hydrates include carbon dioxide, hydrogen sulfide, and several low carbon number hydrocarbons, including methane. Of primary interest for this invention is the recovery of methane from subterranean methane hydrates.

Methane hydrates are known to exist in large quantities in two types of geologic formations: (1) in permafrost regions where cold temperatures exist in shallow sediments and (2) beneath the ocean floor at water depths greater than 500 meters where high pressures prevail. Large deposits of methane hydrates have been located in the United States in Alaska, the west coast from California to Washington, the east coast in water depths of 800 meters, and in the Gulf of Mexico (other well know areas include Japan, Canada, and Russia).

A U.S. Geological Survey study estimates that in-place gas resources within gas hydrates consist of about 200,000 trillion cubic feet which dwarfs the previously estimated 1,400 trillion cubic feet of conventional recoverable gas reserves in the United States. Worldwide, estimates of the natural gas potential of gas hydrates approach 400 million trillion cubic feet.

Natural gas is an important energy source in the United States. It is estimated that by 2025 natural gas consumption in the United States will be nearly 31 trillion cubic feet. Given the importance and demand for natural gas the development of new cost-effective sources can be a significant benefit for American consumers.

Notwithstanding the obvious advantages and potential of methane hydrates, production of methane from gas hydrates is a challenge for the industry. When trying to extract methane from a gas hydrate the sequestered gas molecules must first be dissociated, in situ, from the hydrate. There are typically three methods known that can be used to create this dissociation.

One method is to heat the gas hydrate formation to liberate the methane molecules. This method is disclosed in U.S. Patent Application Publication No. US 2006/0032637 entitled "Method for Exploitation of Gas Hydrates" published on Feb. 16, 2006, and of common assignment with the subject application. The disclosure of this publication is incorporated herein by reference as background information with respect to the subject invention.

Another method envisioned for producing methane hydrates is to inject chemicals into the hydrate formation to change the phase behavior of the formation.

A third technique, which is the subject of the instant invention, is regarded as a depressurization method. This method involves depressurization of a gas hydrate formation and maintaining a relatively constant depressurization on the hydrate formation to allow dissociation and then withdrawing dissociated gas and water through a well casing.

SUMMARY OF THE DISCLOSURE

When applying a pressure drawdown method to produce gas from methane hydrates, a two-phase fluid of gas and water is produced. One aspect of the present disclosure contemplates feeding-back at least a portion of removed water into a well. Production volume will change during a production period to keep constant drawdown pressure. The flow back rate may be controlled by, for example, a choke valve at the surface to maintain a constant pump flow rate. The system can be automated by setting a computer controlled feedback loop based on maintaining a desired depressurization using the bottom hole pressure measurement and maintaining a constant volume of fluid flow through a submerged pump for efficient operation.

Downhole pumps require a minimum flow rate to stabilize their performance, such as, for example, Electro Submersible Pumps (ESP). Some gas hydrate reservoirs, however, do not have enough production or enough stable production flows of methane and water to maintain a minimum flow rate especially in the beginning of production operations when the hydrate layer may have very low permeability yielding low levels of production. On the other hand the target layer may be a prolific water layer yielding a large volume of water. Methane hydrate production flow not only depends on formation permeability, but also on the rate of hydrate dissociation. Accordingly production rates fluctuate over time, and may require pump size changes depending on the production rates at a particular time. The present disclosure includes methods and systems capable for control of the minimum flow rate of a pump.

One way production rate can be controlled is by switching a downhole submersible pump ON and OFF, or by changing the operating frequency of the pump. However, switching the pump ON and OFF can drastically shorten the life of a pump. Also the water hammer effect of the on/off operation can affect the formation stability. On the other hand, each pump has a fixed range of pump rates to operate on. But with fluctuations in the expected production rates of hydrocarbon bearing wells, e.g., gas hydrates, no known existing pumps can handle the wide range of pump rates.

Another option is to use a low flow rate pump instead of a high capacity pump. But in this case, a pump change would be needed when production rate exceeds pump capacity.

An ESP is designed for high production flow rates that are more than 100 $m^3$/day. However, in some hydrocarbon wells production rates do not reach such high flow rates and in that case the downhole pump motor may quickly dry out the pump leading to pump damage. Ideally a pump needs to be working continuously, but production of water and gas by disassociation is dependent on hydrate dissociation size. So the rate of fluid production can change widely during a production period.

To handle this kind of production with an ESP-type pump, a flow rate control system and method are needed that are able to keep the required pump flow rate without having to change the pump rate for low production rates. In addition, the present invention provides temperature control to maintain annulus fluid temperature which prevents ice plug formation.

Flow back rate may be controlled by a choke valve that is located on a flow back loop and main flow line. A downhole pressure gauge value may be used to feed back to these control valves so that downhole pressure may be precisely controlled. Note that the downhole pressure for dissociation hydrate gas production by depressurization is controlled by regulating the hydrostatic pressure which is a function of water level in the well.

THE DRAWINGS

Other features and aspects of the disclosure will become apparent from the following detailed description of some embodiments taken in conjunction with the accompanying drawings wherein.

Figure 3:
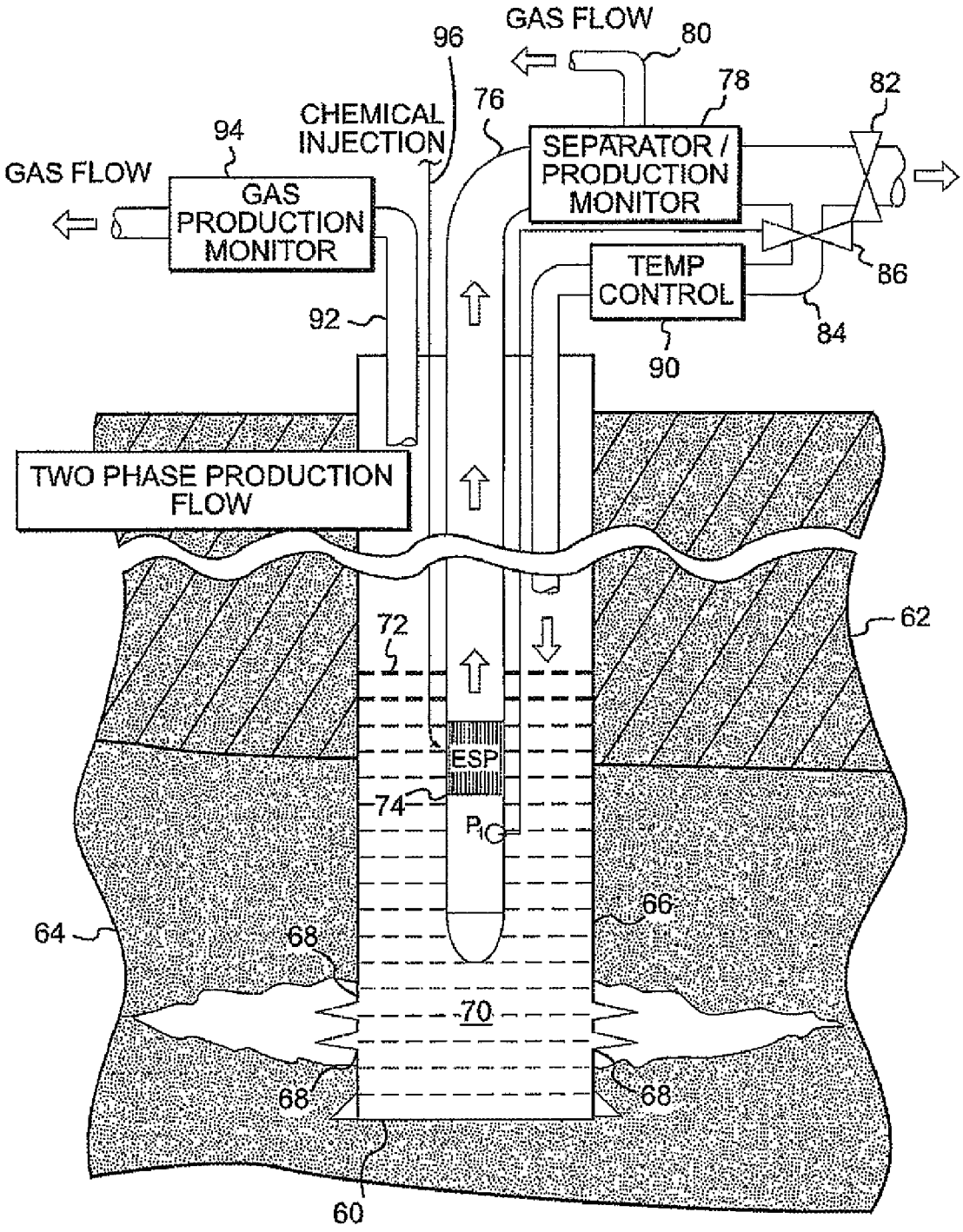
FIG. 3 is a schematic representation of one embodiment of the invention that includes a depressurization gas hydrate production system including maintaining a desired level of pressure within a well including returning water into the well from a surface valve system.
Figure 4:
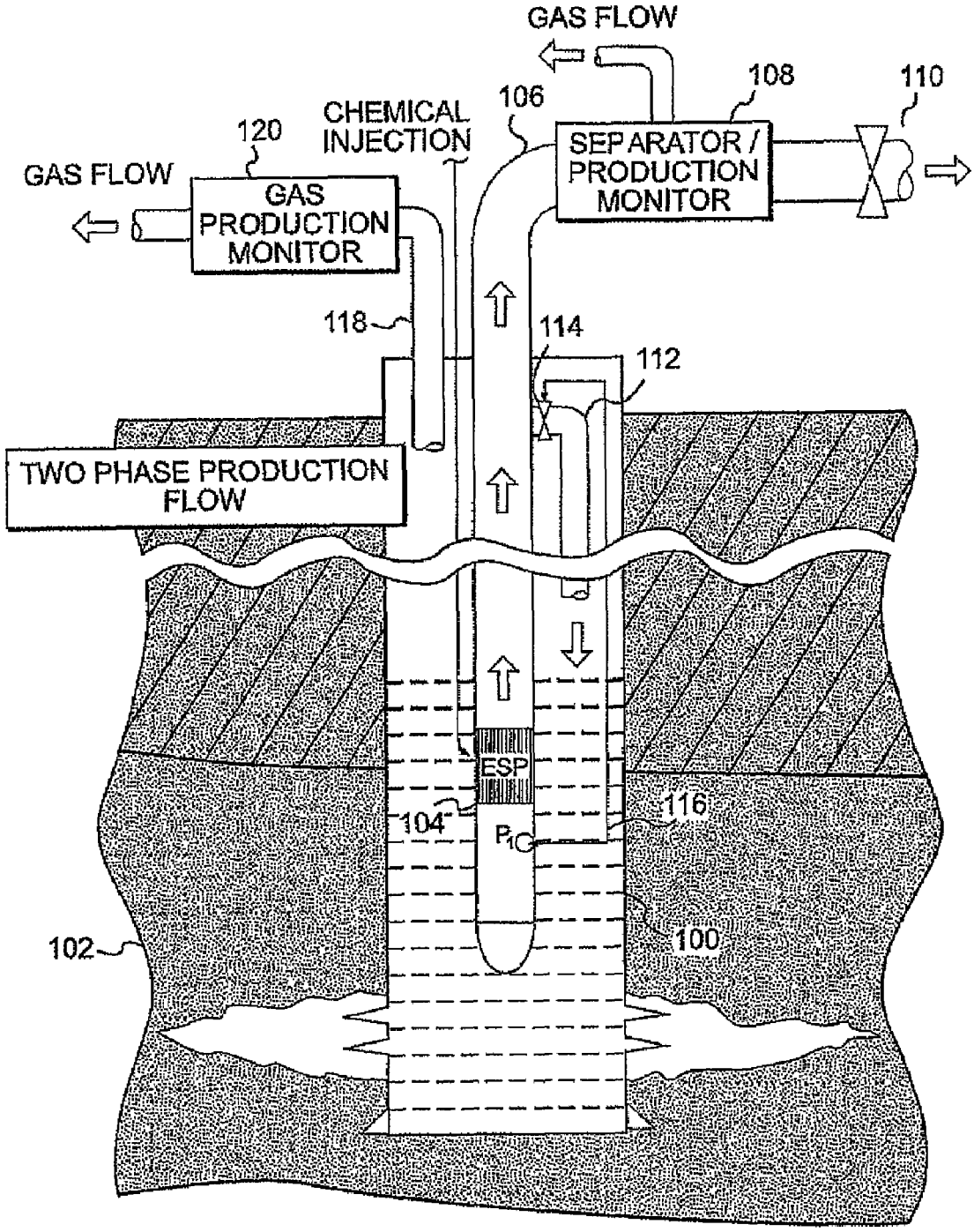
Figure 5:
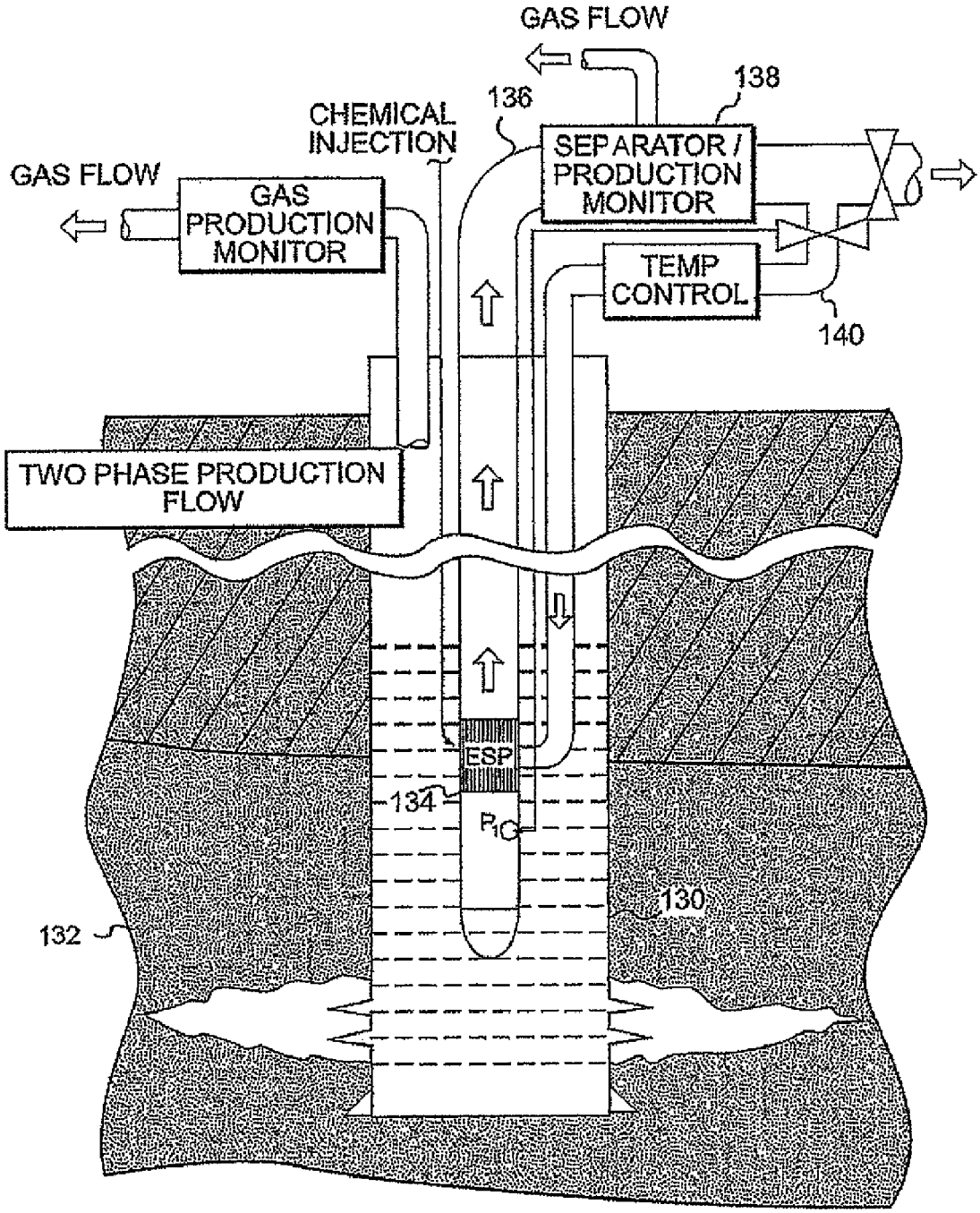

FIG. 4 is a schematic representation of another embodiment of the invention that includes a depressurization gas hydrate production system including maintaining a desired level of pressure within a well including returning gas and water into the well from a location within the well; and FIG. 5 is a schematic representation of yet another embodiment of the invention similar to FIGS. 3 and 4 with a provision for returning at least a portion of fluid from a location downstream of a submerged pump back into the submerged pump to maintain a desired pressure within the production well.

DETAILED DESCRIPTION

Figure 1:
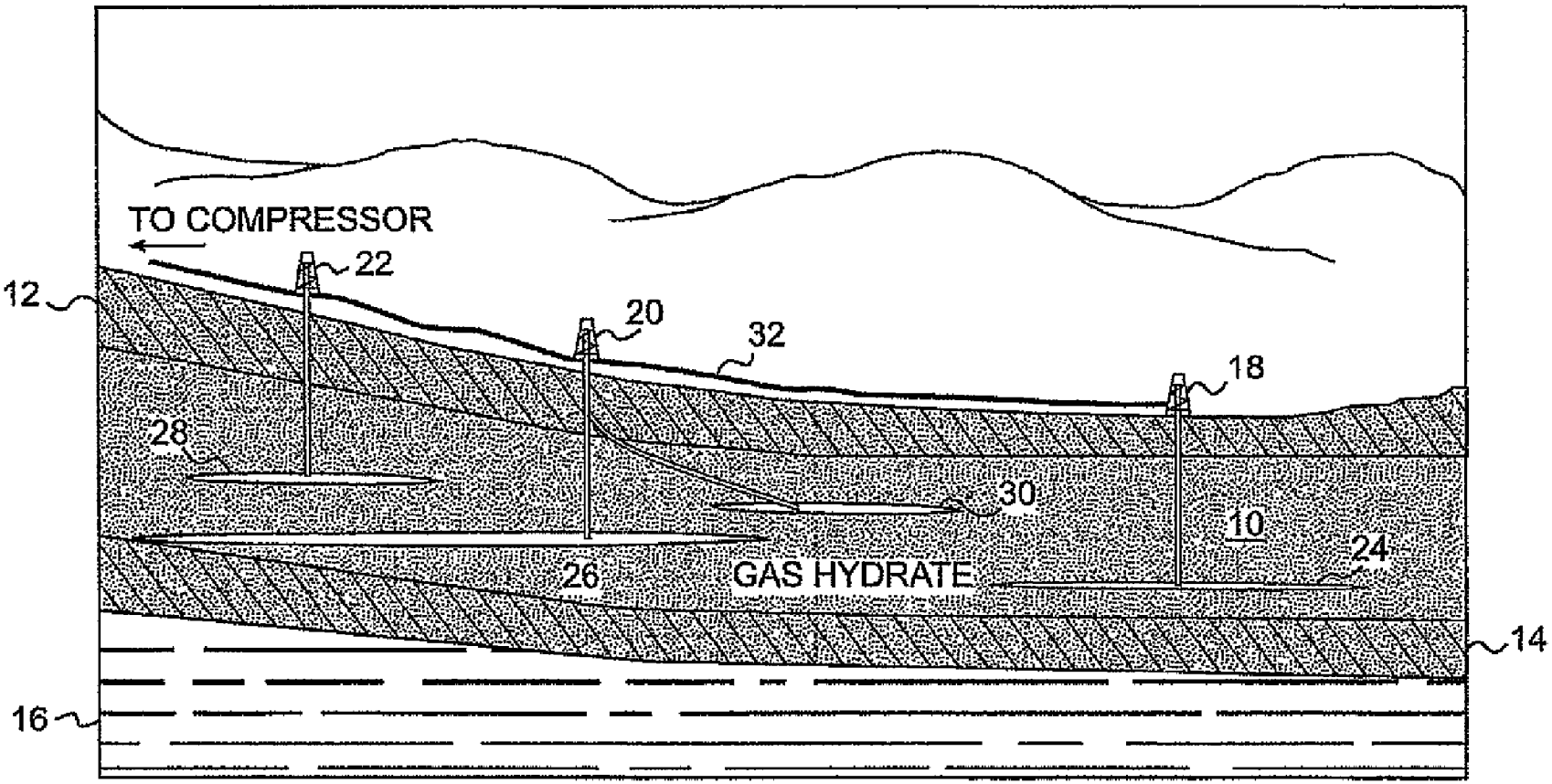
FIG. 1 is a pictorial view of one context or geological region of permafrost in Alaska where gas hydrates are know to exist.

Turning now to the drawings wherein like numerals indicate like parts, FIG. 1 discloses a pictorial representation of one operating context of the invention. In this view a band of gas hydrate 10 lies in a rather shallow geologic zone beneath a permafrost layer 12 such as exists in Alaska. Other earth formations 14 and/or aquifer regions 16 can exist beneath the gas hydrate.

In order to recover sequestered methane gas from within the gas hydrate zone one or more wells 18, 20 and/or 22 are drilled through the permafrost 12 and into the gas hydrate zone 10. Usually a casing is cemented within the well and one or more windows are opened directly into the hydrate zone to depressurize irregular regions of the gas hydrate represented by irregular production zones 24, 26, 28 and 30 extending away from distal terminals of the wells. Although a single well is shown drilled from a single derrick illustrated at 18 and 22 it is envisioned that directional drilling as illustrated at derrick 20 and zone 30 will be a more common practice to extend the scope of a drilling operation.

Once one or more wells are drilled, pressure is relieved from the gas hydrate zone around the well and the methane gas and water molecules will separate and enter the wells. The gas can then be separated from the water and allowed to rise to the surface or is pumped to the surface along with water and separated and fed along a pipeline 32 to a compressor station not shown.

Figure 2:
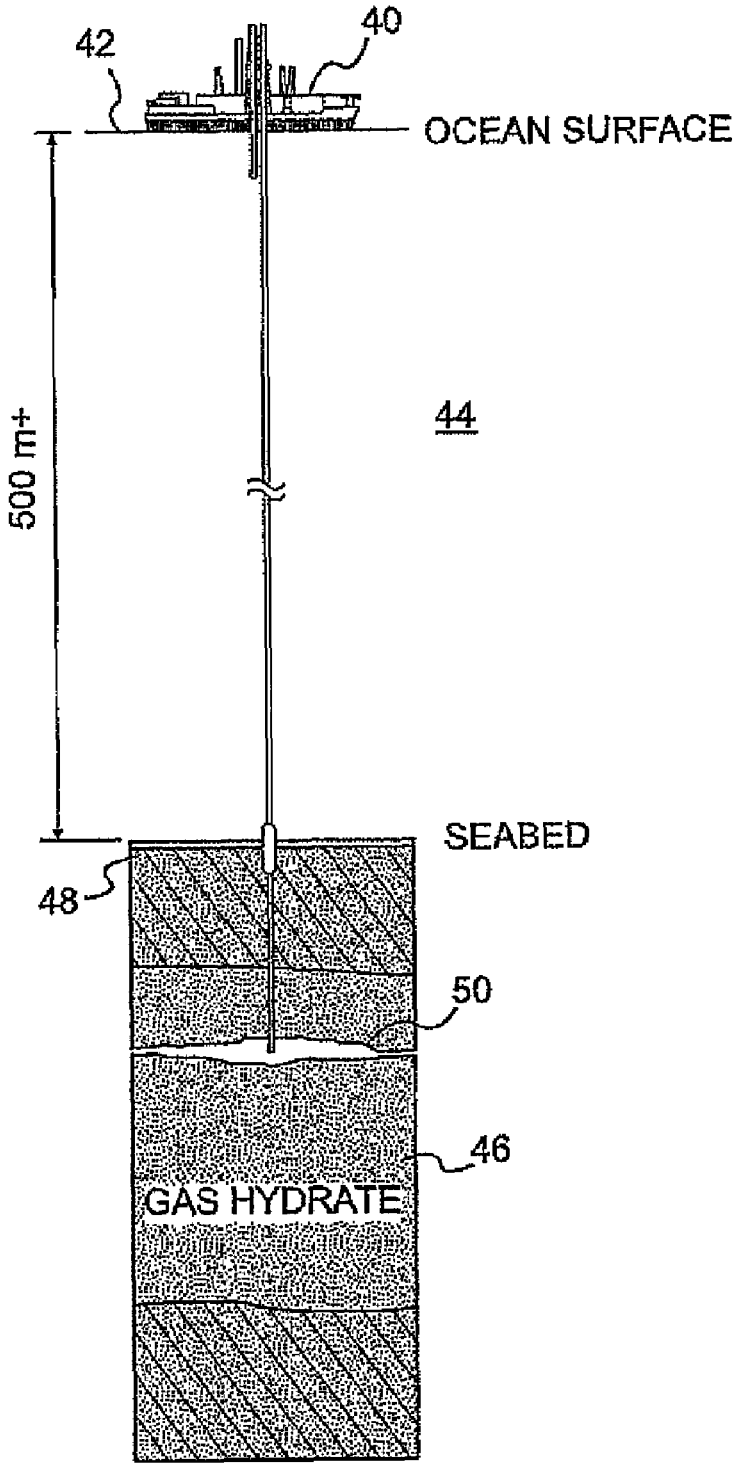
FIG. 2 is a pictorial view of another context or geological region of gas hydrates beneath offshore regions of the United States in water greater than 500 meters.

An alternative operating context of the invention is illustrated in FIG. 2 where a drillship 40 is shown floating upon the surface 42 of a body of water 44 such the Gulf of Mexico. In this marine environment pressures in water depths approximately greater that 500 meters have been conducive to the formation again of geologic layers of gas hydrates 46, such as methane hydrates, beneath the seabed 48.

Offshore drilling in water depths of 500 meters or more is now technically possible so that drilling into the offshore gas hydrate formations 46 and cementing a casing into a well hole offshore to form a production strata 50 is another source of production of methane from a gas hydrate formation. Again, directional drilling from a subsea template enables fifty or more wells to be drilled from a single drillship location.

Turning now to FIG. 3, there will be seen one method and system in accordance with one embodiment of the invention. In this, a well hole 60 is drilled through an earth formation 62 and into a previously identified geologic layer of methane hydrate 64. A casing 66 is positioned within the well and cemented around the outer annulus for production. At a selected depth, which may be relatively shallow for drilling through permafrost or deep if offshore, the casing is perforated by one or more windows 68 which establish open communication between the interior of the well casing and a zone of methane hydrate under pressure. This opening of the well casing will relieve pressure on the surrounding methane hydrate and will enable previously sequestered methane gas to dissociate from the lattice structure of water molecules to form a physical mixture of gas and water. The gas and water 70 will then flow into the well casing 66 and rise to a level 72 within the casing consistent with the level of a desired level of pressure within the well casing. In other words, the submersible pump pumps water out of the well creating a lower hydrostatic pressure on the hydrate formation. This depressurization causes the solid hydrate to dissociate. Once the hydrate dissociates, the water and gas will flow into the wellbore raising the water level which lowers the drawdown pressure which then tends to prevent further dissociation. This is a self limiting process thus the submersible pump is used to pump out the water within the well casing to lower the water level and to maintain the drawdown pressure necessary for continuous dissociation. The pump creates the drawdown pressure. An automated feedback loop maintains a constant drawdown pressure by re-circulating some amount of produced water.

In order to recover methane gas from the mixture, the gas and water mixture is pumped to the surface by an electro submersible pump (ESP) 74 connected to the distal end of a first conduit 76 extending into the well casing 66.

Some downhole pumps require a minimum amount of flow rate to stabilize pump performance, such as an ESP. Some hydrocarbon reservoirs do not have enough production flow, such as in methane hydrate production wells, to efficiently use a full production ESP. Methane hydrate production flow depends on not only formation permeability, but also on the rate or volume of hydrate dissociation. Accordingly production rate may change from time to time which may require the pump size to be changed. The present invention endeavors to provide methods and systems that generate the minimum flow rate of fluids for the pump by a flow back loop that may be used to return pumped out fluid back into the well casing to be recycled. In this, it is possible to handle a wide range of production rates with only one large capacity downhole pump.

At the surface the gas and water mixture passes through a conventional gas and water separator 78 where methane gas is separated, monitored and delivered to a pipe 80 for collection by a compressor unit. Downstream of the separator/monitor 78 is a valve 82 to control the flow of water out of the system. Prior to reaching valve 82 a branch or second conduit 84 is joined into the first conduit and extends back into the well casing 66. This enables water from the well that has been separated from the mixture at 78 to be reintroduced back into the well casing to maintain at least a minimum level of water 72 within the well casing for efficient operation of the ESP 74.

Control of the volume of water reintroduced into the well casing is provided by a choke valve 86 that is positioned within the second conduit 84 as illustrated in FIG. 3. The position of the choke valve can be regulated by a control line running from the intake of the ESP to the choke valve 86. This enables the system to maintain a constant pressure within the well casing 66 by controlling the volume of water reintroduced into the system.

Depending upon the pressure within the well casing there may be a tendency for the gas and water mixture to solidify within the well casing 66, ESP 74 or first conduit 76. The temperature of water returning to the well casing can be regulated by a temperature control unit 90 connected to the return water or second conduit 84 to minimize this issue.

In addition to collecting methane gas from the separator 78 methane gas is drawn directly from the top of the well casing by a third conduit 92 that passes through a gas production monitor 94 which also delivers gas to a compressor storage system.

Depending on the downhole well casing pressure and the pressure within the ESP 74 the gas and water mixture 70 may tend to re-solidify during a pumping operation within the ESP intake (thus upstream of the ESP), within the ESP 74 itself or downstream of the ESP within the first conduit 76. In order to minimize this tendency a fourth conduit 96 is extended within the casing 66 and is operable to feed a chemical, such as methanol, upstream of the ESP 74, directly into the ESP or downstream of the ESP to minimize reformation of methane hydrate within the system.

An alternative embodiment of the invention is disclosed in FIG. 4. In this embodiment a well casing 100 is again cemented into a well bore extending into a methane hydrate zone 102 to be produced. This embodiment is similar to the embodiment of FIG. 3 including an ESP 104 and a first conduit 106 for pumping a gas and water mixture to the surface of a well and into a separator/production monitor 108 to separate the methane gas from water within conduit 106. A valve 110 is positioned downstream of the separator 108 to control the flow of water out of the system.

In this embodiment there is again a second conduit 112 that branches off of the first conduit 106 but in this embodiment the branch is formed within the well casing 100. A choke valve 114 is positioned within the second conduit 112 and serves to regulate the flow of gas and water mixture back into the well casing 100. The choke valve 114 is controlled by a line 116 that leads to a pressure regulator $P_1$ positioned on the ESP in a manner similar to the embodiment of FIG. 3.

Finally, in this embodiment there is again a third conduit 118 that exits from the top of the well casing 100 and into a gas production monitor 120 to deliver recovered methane to a compressor for storage.

FIG. 5 is yet another embodiment of the invention and again includes a well casing 130 that has been cemented within a well hole drilled into a gas hydrate formation 132. In this embodiment an ESP 134 is used to pump a mixture of recovered methane gas and water through a first conduit 136 and out of the well casing and into a separator/production monitor 138 for recovery of the methane gas to storage.

A second conduit 140 is shown in FIG. 5 connected to the first conduit 136 and serves the same purpose as discussed in connection with the second conduit 84 of FIG. 3. In this embodiment however the second conduit 140 extends back into the well casing 130 and directly into the intake of the ESP 134 for direct application of the temperature controlled water into the ESP. In this embodiment feedback directly into the submersible pump is effective for continuous and efficient pump operation.

In a manner similar to the embodiment disclosed in FIG. 4 the second conduit 140 in FIG. 5 could originate from within the well casing 130 in which case the combination of gas and water would be returned directly into the intake of the ESP.

Flow of either heated water as shown in FIG. 5 or a gas and water mixture as alluded to above is controlled by a choke valve that is in turn regulated by a pressure regulator $P_1$ connected at the ESP within the well casing.

In operation a gas hydrate, such as methane hydrate, is produced by a method of decompression or depressurization. In this, a well bore is drilled through permafrost or into the seabed in regions of water of 500 meters or more in depth. When the bore hole is fashioned into the hydrate formation a casing is run and cemented in place. One or more windows are then cut or blasted through the lateral wall of the casing to permit communication between the interior of the casing and the subterranean hydrate formation.

With a release of pressure methane gas dissociates from the water molecules and a mixture of gas and water flows into the well casing. A first conduit carrying an ESP pump at its distal end is lowered into the gas and water mixture and the combination is pumped to the surface for recovery of the gas and discharge or recycling of the water.

A second conduit is joined into the first conduit in one embodiment downstream of the gas separator and in another embodiment within the well casing upstream of the gas separator. In either event water from the first conduit is re-introduced into the well casing to maintain a predetermined desirable flow of water through the ESP system for efficient operation without shutting the pump on and off or using multiple size pumps depending on the rate of flow of the production gas.

A choke valve is used to control the flow of water returning into the well casing and the choke valve is controlled by a pressure gauge $P_1$ connected to the ESP within the well casing.

In one embodiment, the temperature of the return water is heated to help prevent solidification of the methane and water within the well casing. In another embodiment a chemical, such as methanol, is introduced into the pumping operation to minimize solidification of the methane and water mixture during the pumping operation.

Operation in accordance with the subject disclosure enables precise control of the pump operation and drawdown pressure of the formation.

The subject disclosure enables methane production with high capacity pumps at low production rates. In this, one pump may be utilized to cover from zero production to a maximum pump rate production.

Operation in accordance with the subject disclosure enables production of a gas hydrate with a reduction in production fluid disposal.

The subject disclosure provides for the control of annulus fluid temperature to prevent ice plug formation.

Control of chemical injection into the ESP enables the system to avoid hydration within the production flow. Chemicals, such as methanol, may be injected into a flow line or into a separate line and the point of injection may be below or above the ESP or into the ESP depending on the type of situation to be addressed by chemical injection.

Still further the subject disclosure provides enhanced pump efficiency with no gas condensate fluid back flow.

In describing the invention, reference has been made to some embodiments and illustrative advantages of the disclosure. Those skilled in the art, however, and familiar with the subject disclosure may recognize additions, deletions, modifications, substitutions and other changes which fall within the purview of the subject claims.

What is claimed is:

1. A method for the production of a gas hydrate comprising the steps of:

drilling a well into a subterranean gas hydrate formation;

at least partially depressurizing said gas hydrate formation to permit gas and water to flow from the formation into the well;

pumping at least water from the well;

recovering gas from the well;

obtaining a downhole pressure in the well; and introducing water into the well based on the pressure measurement for facilitating said pumping of at least water from the well.

2. A method for the production of a gas hydrate as defined in claim 1 wherein said step of pumping at least water from the well comprises:

pumping a mixture of gas and water from the well.

3. A method for the production of a gas hydrate as defined in claim 2 and further comprising the steps of:

monitoring the downhole pressure within a well casing at a location adjacent a submersible pump within the well casing for pumping a mixture of gas and water from the well casing; and regulating the volume of water introduced into the well for controlling the downhole pressure within the well during the production of a gas hydrate from the subterranean formation.

4. A method for the production of a gas hydrate as defined in claim 3 and further comprising the step of:

regulating the temperature of the water reintroduced into the well to minimize any tendency of water to solidify within the well casing.

5. A method for the production of a gas hydrate as defined in claim 2 and further comprising the steps of:

separating gas and water from the mixture of gas and water pumped from the well; and said step of introducing water into the well includes reintroducing at least some of the water separated from the gas and water back into the well.

6. A method for the production of a gas hydrate as defined in claim 5 wherein said step of reintroducing water into the well comprises:

reintroducing water into an intake port of a submersible pump positioned within the well casing for pumping the mixture of gas and water from the well casing.

7. A method for the production of a gas hydrate as defined in claim 5 wherein said step of recovering gas comprises:

recovering gas directly from a casing positioned within the well; and recovering gas from the step of separating gas and water from the mixture of gas and water pumped from the well.

8. A method for the production of a gas hydrate as defined in claim 2 and further comprising the step of:

introducing a chemical into the flow stream of gas and water from the well to minimize any tendency of the gas and water mixture solidifying during the pumping operation.

9. A method for the production of a gas hydrate as defined in claim 8 wherein said step of introducing a chemical comprises;

introducing methanol into the stream of flow of gas and water.

10. A method for the production of a gas hydrate as defined in claim 9 wherein said step of introducing methanol into the stream of flow of gas and water comprises:

introducing the methanol downstream of the output of the pump pumping gas and water from the well.

11. A method for the production of a gas hydrate as defined in claim 9 wherein said step of introducing methanol into the stream of flow of gas and water comprises:

introducing the methanol into the pump pumping gas and water from the well.

12. A method for the production of a gas hydrate as defined in claim 9 wherein said step of introducing methanol into the stream of flow of gas and water comprises:

introducing the methanol upstream of the intake of the pump pumping gas and water from the well.

13. A method for the production of a gas hydrate as defined in claim 2 wherein said step of introducing water into the well comprises:

diverting at least some of the gas and water within the well and downstream of the pump back into the well.

14. A method for the production of a gas hydrate as defined in claim 2 wherein said step of introducing water into the well comprises:

diverting at least some of the gas and water within the well and downstream of the pump; and reintroducing the gas and water into the intake of the pump used to pump the mixture of gas and water from the well.

15. A method for the production of a gas hydrate as defined in claim 2 wherein said step of pumping a mixture of gas and water comprises:

pumping a mixture of methane and water.

16. A method for the production of a gas hydrate as defined in claim 1, wherein the downhole pressure is a hydrostatic pressure in the well near an inlet of a pump.

17. A system for producing gas from a subterranean gas hydrate comprising:

a well casing extending from an earth surface into a gas hydrate subterranean zone, said casing having at least one opening therein for permitting a depressurized mixture of gas and water to flow from the gas hydrate subterranean zone into said casing;

a submersible pump submerged within a gas and water mixture within said well easing for pumping the gas and water mixture to the surface;

a first conduit connected to said submersible pump and extending upward through said well casing for delivering the gas and water mixture pumped from said submersible pump to the surface and out of said well casing;

a second conduit connected to said first conduit outside of said well casing and extending back into said well casing for reintroducing water back into said well casing;

a valve positioned outside of said well casing and in said second conduit for regulating the volume of water reintroduced back into said well casing;

a pressure sensor disposed in the well in proximity of the submersible pump for measuring a hydrostatic pressure in the well; and a controller operatively connecting the valve and the pressure sensor whereby the valve is regulated based on a pressure measurement from the pressure sensor for maintaining sufficient water within said well casing to maintain continuous operation of said submersible pump within said well casing.

18. A system for producing gas from a subterranean gas hydrate as defined in claim 17 and further comprising:

a separator connected to said first conduit between said well casing and said valve for separating gas and water pumped out of said well casing.

19. A system for producing gas from a subterranean gas hydrate as defined in claim 17 and further comprising:

a temperature control connected to said second conduit between said valve and said well casing for maintaining water temperature that is reintroduced into said well casing at a temperature to minimize a tendency of water within said well casing from solidifying during a pumping operation of the gas and water out of said well casing.

20. A system for producing gas from a subterranean gas hydrate as defined in claim 17 and further comprising:

a third conduit that extends into said well casing and extends out of said well casing to permit gas within said casing to be recovered; and a gas production monitor connected to said third conduit for measuring the volume of gas that flows out of said well casing.

21. A system for producing gas from a subterranean gas hydrate as defined in claim 20 and further comprising:

a fourth conduit extending into said well casing and operably connected to said first conduit for injecting a chemical upstream of said submersible pump to prevent gas and water that is being pumped by said submersible pump from solidifying within one of said first conduit and said submersible pump.

22. A system for producing gas from a subterranean gas hydrate as defined in claim 20 and further comprising:

a fourth conduit extending into said casing and operably connected to said submersible pump for injecting a chemical into said pump to prevent gas and water being pumped by said submersible pump from solidifying within one of said first conduit and said submersible pump.

23. A system for producing gas from a subterranean gas hydrate as defined in claim 20 and further comprising:

a fourth conduit extending into said well casing and operably connected to said first conduit for injecting a chemical downstream of said submersible pump to prevent gas and water being pumped by said submersible pump from solidifying within said first conduit.

24. A system for producing gas from a subterranean gas hydrate as defined in claims 17 wherein said gas and water mixture comprises methane and water.

25. A system for producing gas from a subterranean gas hydrate comprising:

a well casing extending from an earth surface into a gas hydrate subterranean zone, said casing having at least one opening therein for permitting a mixture of gas and water to flow from the gas hydrate subterranean zone into said casing;

a submersible pump submerged within a gas and water mixture within said well casing for pumping the gas and water mixture to the surface;

a first conduit connected to said submersible pump and extending upward through said casing for delivering the gas and water mixture pumped from said submersible pump to the surface and out of said casing;

a second conduit connected to said first conduit within said casing and extending within said casing for reintroducing water back into said well casing; and a valve positioned within said well casing and in said second conduit for diverting at least a portion of the gas and water mixture being pumped out of the well casing back into the well casing for maintaining sufficient water within said well casing to maintain continuous operation of said submersible pump within said casing, wherein the amount of diverted mixture is based on a pressure measurement of the well obtained in a proximity of the submersible pump.

26. A system for producing gas from a subterranean gas hydrate as defined in claim 25 and further comprising:

a pressure control mounted downhole within said well casing adjacent to said submersible pump and being connected to said valve for controlling downhole pressure within said well casing by regulating the volume of gas and water reintroduced into said well casing.

27. A system for producing gas from a subterranean gas hydrate as defined in claim 25 and further comprising:

a third conduit that extends into said well casing and extends out of said well casing to permit gas within said casing to be recovered; and a gas production monitor connected to said third conduit for measuring the volume of gas that flows out of said well casing.

28. A system for producing gas from a subterranean gas hydrate as defined in claims 25 wherein said gas and water mixture comprises methane and water.

* * * * *